United States Patent [19]

Deutsch

[11] 4,152,966

[45] May 8, 1979

[54] AUTOMATIC CHROMATIC GLISSANDO

[75] Inventor: Ralph Deutsch, Sherman Oaks, Calif.

[73] Assignee: Kawai Musical Instrument Mfg. Co. Ltd., Hamamatsu, Japan

[21] Appl. No.: 839,915

[22] Filed: Oct. 6, 1977

[51] Int. Cl.[2] ..... G10H 1/02; G10H 5/00

[52] U.S. Cl. ..... 84/1.24

[58] Field of Search ..... 84/1.01, 1.24, DIG. 2, 84/DIG. 20

[56] References Cited

U.S. PATENT DOCUMENTS

| | | | |
|---|---|---|---|
| 4,073,209 | 2/1978 | Whittington et al. | 84/1.24 |
| 4,080,862 | 3/1978 | Hiyoshi et al. | 84/1.24 |
| 4,083,283 | 4/1978 | Hiyoshi et al. | 84/1.24 |

*Primary Examiner*—Stanley J. Witkowski
*Attorney, Agent, or Firm*—Christie, Parker & Hale

[57] ABSTRACT

A keyboard operated tone synthesizer with glissando effect in which actuating individual keys successively on a keyboard produces all the intermediate notes of the chromatic scale. The time interval between notes in the scale is independently controllable. In one modification of the invention the individual notes of the chromatic scale played during the glissando, when played slowly enough to be heard individually, can be controlled in attack, decay, sustain and release characteristics. The chromatic glissando can move either up or down the scale, depending upon the pitch of each key relative to the previous key played on the keyboard.

6 Claims, 3 Drawing Figures

HOLD REGISTER
608
COMPARATOR
603
END
DIRECTION LATCH
604
GLISSANDO CLOCK
654
87
FREQUENCY NUMBER TABLE
18
DATA SELECT GATE
601
ACCUMULATOR REGISTER
602
SEMI-TONE MULTIPLIER (INPUT X 2 1/12)
605
CLOCK GATE
655
ADDRESS DECODE
16
OUTPUT DATA SELECT
610
FLIP-FLOP
653
DIGITAL TO ANALOG CONVERTER
22
520
ASSIGNMENT MEMORY
82
ADDRESS DATA WRITE
83
VOLTAGE CONTROLLED OSCILLATOR
24
GLISSANDO ON
86
87

AUTOMATIC CHROMATIC GLISSANDO

FIELD OF THE INVENTION

This invention relates to musical instruments of the tone synthesizer type, and more particularly, is concerned with providing a chromatic glissando effect in a digitally controlled tone synthesizer.

BACKGROUND OF THE INVENTION

Glissando is a musical effect in which a transition is made from a first note to a second note by playing a sequence of intermediate notes. In a keyboard instrument such as a piano, the notes are played by running the finger over either the intermediate white keys or intermediate black keys. Thus the intermediate tones correspond to the diatonic tone intervals of the musical scale. However, to play a chromatic glissando in which all the intermediate black and white keys are successively operated is extremely difficult to play rapidly since it requires extreme manual dexterity to accomplish, such as a fast full chromatic transition between two designated notes.

The present invention is directed to a circuit for producing a chromatic glissando effect in a keyboard-operated instrument of the type described in my copending application Ser. No. 603,776, filed Aug. 11, 1975, now issued as U.S. Pat. No. 4,085,644 and entitled "Polyphonic Tone Synthesizer". In the musical instrument therein described, the waveform of each note is controlled by data calculated and stored in a master data list, the data being converted by a digital-to-analog converter to an analog voltage for driving a conventional audio sound system. The fundamental frequency of the waveform is determined by a voltage-controlled oscillator, the input control voltage to oscillator in turn being determined by addressing a frequency control number from a frequency number table and converting the frequency number to a corresponding voltage level. A particular key on the keyboard determines the address of the frequency number stored in the number table, all in a manner more specifically described in copending application Ser. No. 634,533, filed Nov. 24, 1975, now issued as U.S. Pat. No. 4,067,254 and entitled "Frequency Number Control Clocks" and U.S. Pat. No. 4,022,098 entitled "Keyboard Switch Detect and Assigner".

In implementing the glissando effect in the present invention, techniques similar to those described in my copending application Ser. No. 718,791, filed Aug. 30, 1976, entitled "Constant Speed Portamento", assigned to the same assignee as the present application and now U.S. Pat. No. 4,103,581 herein incorporated by reference, are employed. The portamento effect is similar to the glissando effect in that the transition between two notes is characterized by the sliding of the pitch of each note in a smooth transition to the pitch of the next note as successive keyed notes are played on the keyboard. The portamento effect differs from the chromatic glissando effect in that in the portamento effect of the pending application, the transition takes place over a time interval which is independent of the difference in frequency of the successively keyed notes. The incremental frequency steps involved in the transition are a fixed ratio of the difference in frequency between the two notes. Thus there is no relationship between the incremental steps and the steps of the chromatic scale, for example. In contrast, in the glissando effect the transition is made by sounding each of the individual notes in the chromatic scale in the interval between the beginning and ending keyed notes, so that the time of transition is a function of the frequency separation between the two keyed notes. The audible effect is therefore considerably different. The transition time in the glissando effect can be made sufficiently slow so that each individual note of the chromatic scale can be audibly distinct, if desired. Moreover, each of the transition notes can be sounded with the same attack, decay, sustain and release characteristics of the starting and ending notes.

SUMMARY OF THE INVENTION

In brief, the present invention, in its preferred embodiment, provides a glissando tone generator in which a frequency number for each of the keyed notes of the chromatic scale is stored in a table. The frequency numbers are selectively read out of the table in response to operation of the keys on the keyboard, each key having its own frequency number. When read out of the table a frequency number is converted to an analog voltage and applied to a voltage controlled oscillator for fixing the fundamental frequency of the associated tone generator. The glissando generator includes a glissando clock. The address of the frequency number in the table is stored in a first register for a first note being generated in response to operating a first key. When another key is subsequently operated, the frequency number address of the new note is stored in a second register. The first register is then counted up or down by a series of clock pulses from a glissando clock generator until the address in the first register is equal to the new address in the second register. The contents of the first register are used to address and read out the frequency numbers in sequence from the frequency number table as the register is counted. Thus as the address is counted up, each successive frequency number in the number table of all the intermediate notes between the former note and the current note are read out in succession from the frequency number table. Each of these numbers in turn controls the fundamental frequency of the tone generator so that the tone generator steps through the frequencies of all the notes forming the chromatic scale.

In an alternative form of the invention, the address number itself is incremented in a series of steps by multiplying the number by a constant so as to in effect calculate a series of frequency numbers which substantially match the frequency numbers of the notes in the chromatic scale.

BRIEF DESCRIPTION OF THE DRAWINGS

For a better understanding of the invention reference should be made to the accompanying drawings, wherein.

DETAILED DESCRIPTION

In copending application Ser. No. 603,776, entitled "Polyphonic Tone Synthesizer", now issued as U.S. Pat. No. 4,085,644 there is described a musical tone generating system in which any one of a plurality of tone generators is assigned to a note when a key is actuated. As each key is actuated on the instrument, data identifying the note and the key assignment status is stored in a Read/Write assignment memory. A suitable circuit, indicated at 14 in FIG. 11, for sensing the condition of the keys and storing such information, is described in U.S. Pat. No. 4,022,098 entitled "Keyboard Switch Detect and Assignor". Once a key is assigned to a note generator, the pitch of the note is determined by a voltage controlled oscillator in the assigned tone generator in response to the note information stored when the key is actuated. The manner of controlling the frequency of the oscillator for each tone generator is described in detail in the above-identified application Ser. No. 634,533, filed Nov. 24, 1975, and now U.S. Pat. No. 4,067,254. The present invention, while not specifically limited to an instrument incorporating the features of the above-identified patent applications, is described herein in the preferred embodiment as a modification to such a system. Portions of the circuit described herein which are common to the circuits described in the above-identified copending applications are identified by the same reference numbers.

Figure 1:
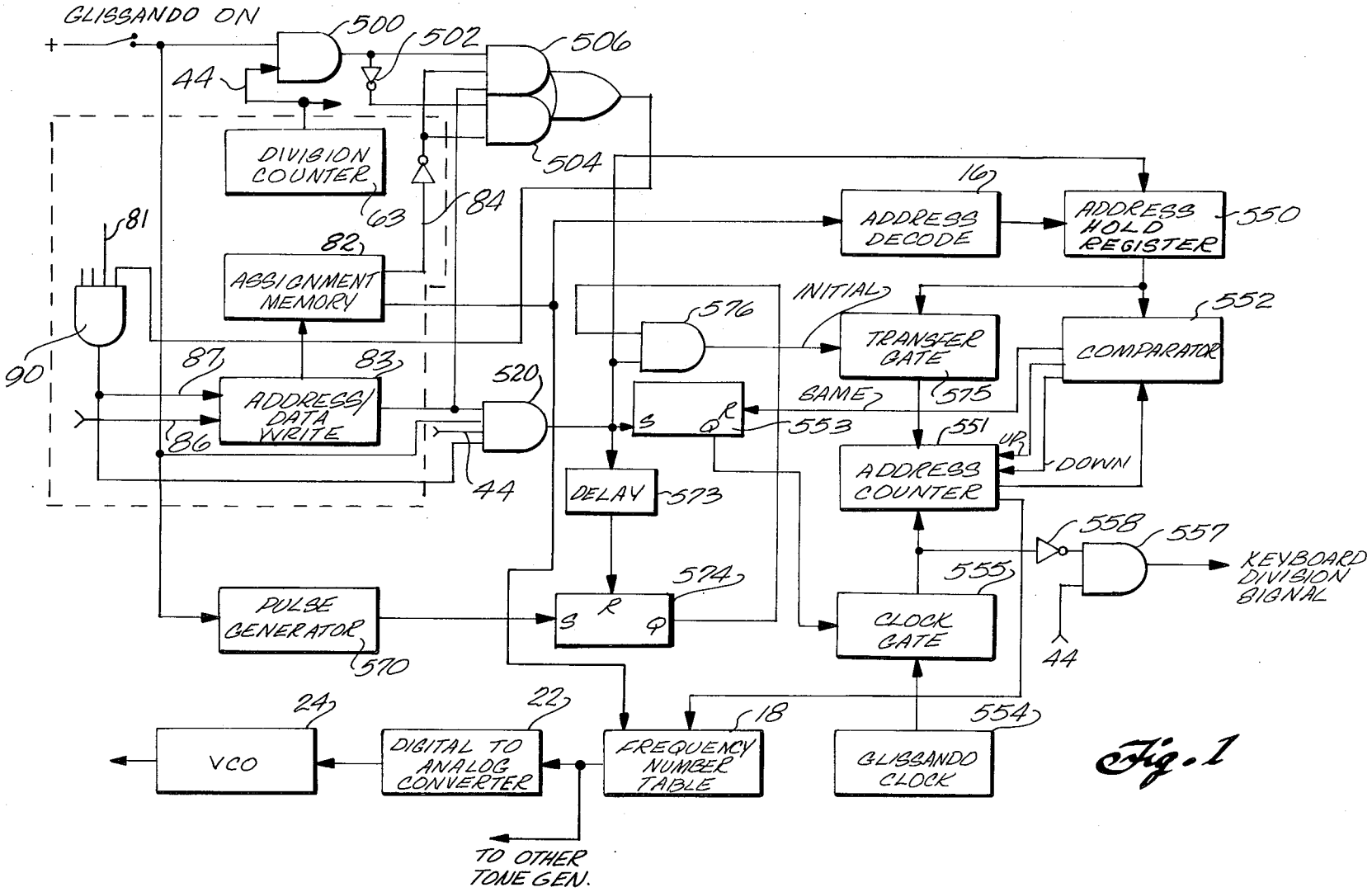
FIG. 1 is a schematic block diagram of the preferred embodiment of the present invention.

Referring to FIG. 1 in detail, the numeral 82 refers to an assignment memory which stores a plurality of control words, one for each tone generator of the polyphonic system. It is assumed for the purposes of the present disclosure that one tone generator is permanently assigned to the glissando mode of operation and therefore one control word in the assignment memory 82 is always associated with the dedicated glissando tone generator. When operating in the glissando mode only the upper keyboard is used and only a single note at a time can be played. In other words, when operating in the glissando mode, the upper keyboard is restricted to monophonic operation. The keyboard and associated keyboard switch detect circuit may be modified to limit the keyboard to monophonic operation by a priority circuit (not shown) that allows only a single output signal when more than one key is operated at a time. Such a monophonic control is described, for example, in my copending application Ser. No. 712,736, filed Aug. 9, 1976, entitled "An Automatic Digital Circuit for Generating Chords in a Digital Organ", assigned to the same assignee as the present application and now U.S. Pat. No. 4,100,831.

As described in the above-identified U.S. Pat. No. 4,022,098, whenever a key on the keyboard is operated, a signal is generated on a line 87 going to a Memory Address/Data Write control 83 which causes one of the control words in the assignment memory to be assigned to that key by turning on an assignment bit in the control word and loading the control word with the data identifying the note, the octave in which the note is located, and the keyboard in which the key is located. Once a control word is assigned to a key, it is used to address a frequency number in a table, which number in turn is used to control a voltage-controlled oscillator in an assigned tone generator, in the manner described in detail in the above-identified copending application Ser. No. 634,533, and now U.S. Pat. No. 4,067,254. The signal on line 87 is derived from the output of an AND gate 90 which senses an input on line 81 indicating that a key has been operated and that the control word being addressed in the assignment memory 82 has the assignment bit turned off. The latter condition is present because the control word has not been assigned to any other key. The status of the assignment bit is sensed by an output line 84 from the assignment memory 82 which normally is applied directly to the input of the AND gate 90 through an inverter. However, when operating in the glissando mode, an AND gate 500 senses that the glissando mode is on, as indicated by a signal on an input line GLISSANDO, and that the upper keyboard is being scanned, as indicated by a signal on the input line 44 from the division counter 63, as described in detail in U.S. Pat. No. 4,022,098. The output of the AND circuit 500 is applied through an inverter 502 to the input of an AND gate 504 together with the output of the inverter in the line 84. Thus when the glissando is not present, the line 84 is coupled through the inverter to the AND gate 90 exactly in the manner described in the above-identified U.S. Pat. No. 4,022,098. However, when the glissando mode is on, an AND circuit 506 couples an output signal from the address circuit 83 to the input of the AND circuit 90, indicating that the control word assigned to the glissando tone generator is being addressed in the assignment memory. Line 87 causes the glissando control word in the assignment memory to be loaded with the note, octave, and keyboard information by means of the Memory Address-/Data Write control 83 in the manner described in detail in U.S. Pat. No. 4,022,098. Thus whenever operating in the glissando mode, the specific control word dedicated to glissando tone generation is loaded with data identifying the particular key in the upper keyboard that is being depressed.

The control words in the assignment memory are read out of the assignment memory in sequence and applied to the input of an address decoder 16. The value of the address decoder in response to each control word is used by the assigned tone generator to address a frequency number in a memory table 18. This frequency number controls the frequency of a voltage controlled oscillator in the assigned tone generator, in the manner described in detail in the above-mentioned application Ser. No. 634,533, and now U.S. Pat. No. 4,067,254. When the specific control word in the assignment memory 82 associated with the glissando mode is read out of the assignment memory 82, the decoded address is stored in the address hold register 550. Thus the address hold register 550, when operating in a glissando mode, stores the address of the frequency number in the frequency number table 18 for the current note played on the keyboard. AND gate 520 provides an output signal when the Address/Data Write circuit 33 is addressing the word assigned to glissando in the assignment memory 82, and the glissando mode is on and a key has been depressed. The output of the AND gate 520 is also used to set a control flip-flop 553 for controlling a clock gate 555 which gates clock pulses from a glissando clock 554 to an address counter 551. The content of the address counter 551 is used to address frequency numbers in the frequency number table 18 of the glissando tone generator.

The address counter 551 is either counted up or counted down depending upon the output of a comparator circuit 552 which compares the contents of the address counter 551 with the contents of the address hold register 550. If the address in the register 550 corresponds to a higher frequency number location than the address in the counter 551, the comparator sets the address counter to count up in response to clock pulses from the clock source 554. If the comparator indicates the address in the hold register 550 corresponds to a lower frequency number location, the comparator causes the address 551 to count down in response to clock pulses from the source 554. Thus each clock pulse from the glissando clock 554 causes the next frequency number in sequence in the table 18, either up or down, to be read out and applied to the digital-to-analog converter 22 for controlling the frequency of the voltage controlled oscillator 24. Since each frequency number in the table 18 corresponds to the pitch of a note in the chromatic scale, the tone generator is thus caused to generate sequentially the tones of the chromatic scale. By making the glissando clock 554 adjustable by the player of the instrument, a fast or slow glissando effect is produced.

The address counter 551 continues to count up or down until the comparator 552 senses that the address in the counter is equal to the address in the hold register 550. At this time the output of the comparator 552 resets the control flip-flop 553, thereby interrupting the sequencing of the counter 551 by the glissando clock 554. Thus the glissando run terminates when the frequency number corresponding to the actuated key is addressed by the address counter 551. The tone generator continues to generate the keyed note until the key is released.

If another key is then actuated, the associated address is loaded in the address hold register 550, in the manner described above. The control flip-flop 553 is again set and a glissando run commences starting at the frequency of the prior tone as currently being addressed by the counter 551. It should be noted that the chromatic glissando may never reach the frequency of an actuated key before the key is released and a new key is operated. In this case, the control flip-flop 553, not having been reset, causes the address counter 551 to continue to count. However, the comparator now compares the address counter 551 with the address loaded in the hold register 550 by the new key. If this is lower than the address in the counter 551, the direction of the glissando run may reverse, but otherwise it continues without interruption until a point in time in which the address counter 551 is equal to the address in hold register 550.

Since the content of the address counter 551 is unknown at the time the glissando mode is initiated, it is desirable to initially load the address counter with the address of the first key depressed after the glissando mode is initiated. By doing this no glissando run is produced until the second key is actuated, placing a new address in the hold register 550. This is accomplished by a control flip-flop 574, an AND gate 576, and a transfer gate 575. When the glissando switch is first closed, a pulse generator 570 sets the control flip-flop 574, which turns on one input to the AND gate 576. When the output of the AND gate 520 signals that a key in the upper division has been depressed, the output of the AND gate 576 causes the transfer gate 575 to transfer the current address in the address hold register 550 to the address counter 551. The comparator 552, in response to the presence of the same address in the register 550 and counter 551, resets the control flip-flop 553 to interrupt any counting of the counter 551 from the glissando clock 554. After a short delay provided by a delay circuit 573, the output of the AND gate 520 resets the control flip-flop 574, thereby again closing the transfer gate 575. The address counter 551 is now set to the address of the frequency number of the first key operated in the glissando mode.

When a relatively slow glissando effect is provided so that each note in the chromatic scale is played for a long enough interval to be distinctly heard, it may be desirable to sound each note in the chromatic scale with the same attack, decay, sustain, and release characteristic as those notes initiated by actually playing a key. Normally, operation of a key not only starts a tone generator but also starts an ADSR generator which in turn controls the envelope waveform of the tone being generated, i.e., the attack, decay, sustain, and release characteristic of the generated musical tone. Operation at the ADSR generator is described, for example, in copending application Ser. No. 652,217, filed Jan. 26, 1976, now issued as U.S. Pat. No. 4,079,650 and entitled "ADSR Envelope Generator". In the above glissando arrangement, since only the frequency number is changed to sound each of the successive notes in the chromatic scale, the attack and decay are controlled by the ADSR generator only on the first note sounded when a key is actuated. To provide the same attack, decay characteristic on each of the notes sounded on the chromatic during the glissando run, the tone generator must be operated as though a new key were actuated with each pulse of the glissando clock 554. To this end, the output of the division counter 63 on the line 44 is connected to the keyboard switching logic, as shown in the above-identified U.S. patent, through a gate 557 which is also connected to the output of the clock gate 555 through an inverter 558. Thus, each clock pulse from the source 554 momentarily inhibits the signal on the line 44 from the division counter 63. This has the effect on the key detect circuit of momentarily releasing all of the keys on the upper division keyboard. As a result, with each glissando clock from the clock source 554, a key is reassigned to the glissando word in the assignment memory 82 just as though the key had been physically released and then again depressed. Since the same key remains depressed, the address information in the hold register 550 is unchanged and the glissando run continues on uninterrupted. However, the ADSR generator is recycled just as though a new key had been actuated.

Figure 2:
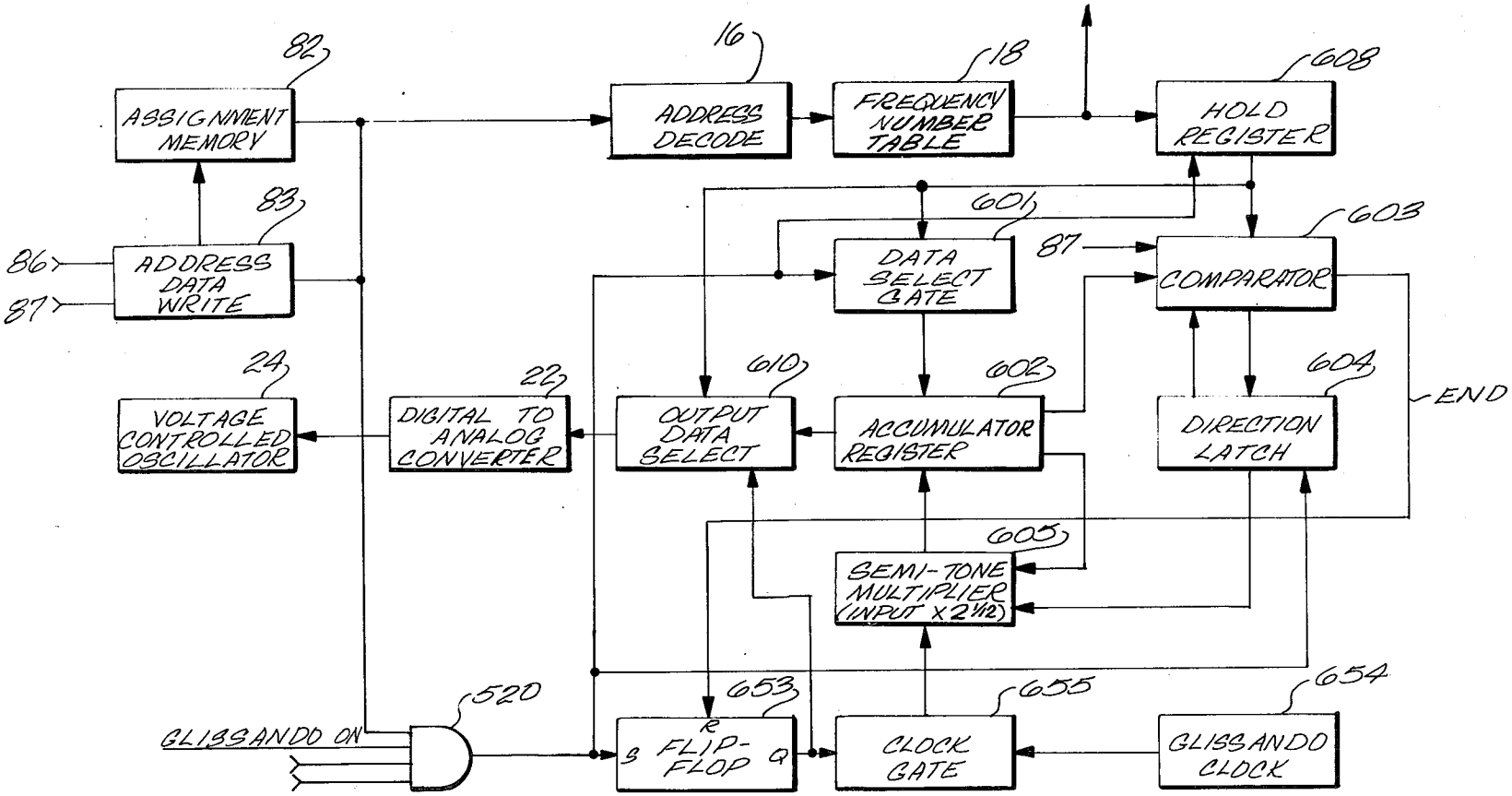
FIG. 2 is a schematic block diagram of an alternative embodiment of the present invention.

In the arrangement shown in FIG. 1, the chromatic glissando is obtained by incrementing the frequency number table address sequentially until it is the same as the new keyboard number address, thereby causing a full interval range of chromatic notes to be read out from the frequency number table. FIG. 2 shows an alternative arrangement for implementing the glissando effect by generating the frequency numbers themselves rather than reading the frequency numbers out of a table. Thus the chromatic glissando is obtained by successively multiplying the frequency number of the previous note played by a factor of $2^{1/12}$ or $2^{-1/12}$ depending upon whether the frequency number of the current note is higher or lower than the prior note. This produces a frequency number which changes exponentially to a very close approximation of the equi-tempered chromatic scale. The multiplications are timed by a variable note glissando clock. The successive multiplications are terminated when the resultant of the successive multiplications is a number which is equal to or exceeds the frequency number of the new note.

Referring to FIG. 2 in detail, after the assignment memory 82 is loaded in response to a key operated during the glissando mode, in the manner described above in detail in connection with FIG. 1, the word in the assignment memory 82 is decoded by the address decode 16 and used to directly address the frequency number table 18. The output of the AND gate 520 indicates that a glissando is on and that the word assigned to the glissando tone generator is being applied to the address decode 16 in response to a key being actuated on the upper division keyboard. The frequency number from the table 18 is transferred to a hold register 608 in response to the output of the AND gate 520. At the same time, the previous frequency number stored in the hold register number 608 is transferred by the data select gate 601 to an accumulator register 602.

A comparator circuit 603 makes a comparison between the previous frequency number in the accumulator register 602 and the new frequency number in the hold register 608 at the time a new key is actuated, as indicated by input line 87. The comparator 603 sets a direction latch 604 to a zero state if the frequency number of the new note is lower in pitch than the previous note, and sets the latch to a "1" state if the new note is higher in pitch or equal to the old note.

The latch 604 controls a semi-tone multiplier 605 which operates to multiply the contents of accumulator register 602 by the factor of $2^{1/12}$ or $2^{-1/12}$, depending on the setting of the latch 604. The product is stored back in the accumulator register 602.

The semi-tone multiplier 605 thus operates to periodically change the frequency number in the accumulator register 602 by an amount equivalent to a half tone of the chromatic scale. The output of the accumulator register 602 is applied to the digital analog converter 22 for controlling the voltage control oscillator 24.

The sequence of multiplications produced by the semi-tone multiplier 605 is synchronized with a glissando clock 654, the synchronizing clock pulses being gated to the semi-tone multiplier 605 through a clock gate 655. A control flip-flop 653, which is set by the output of the AND gate 520, controls the clock gate 655. The multiplication and updating of the contents of the accumulator register 602 continues with each successive glissando clock pulse from the source 654 until the comparator 603 generates a reset pulse which is applied to the flip-flop 653. The reset pulse is generated by the comparator 603 when the contents of the accumulator register 602 becomes equal to or exceeds (in either direction depending on the setting of latch 604) the frequency number in the hold register 608. The control flip-flop 653 also controls an output data select gate 610. When the control flip-flop 653 is set, the gate 610 couples the contents of the accumulator register 602 to the digital-to-analog converter 22, but when the control flip-flop 653 is reset the gate 610 switches to the output of the hold register 608.

Figure 3:
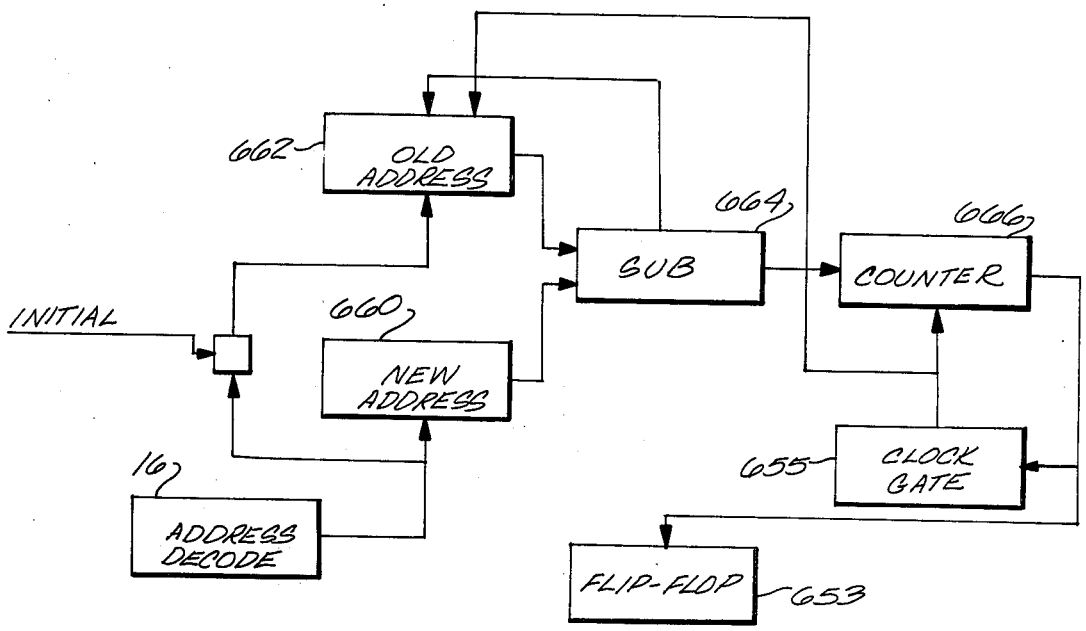
FIG. 3 is a schematic block diagram of a modification to the circuit of FIG. 2.

An alternative arrangement for resetting the control flip-flop 653 is shown in FIG. 3. When a key on the keyboard is depressed, causing the frequency number table 18 to be addressed, the address is stored in a New Address register 660. When a subsequent key is operated, the previous address in the register 660 is transferred to an Old Address register 662. Thus the register 660 always contains the address of the current note and the register 662 contains the address of the previous note. A subtract circuit 664 generates the difference between the two addresses, and stores the difference in a counter 666. During the execution of the glissando, glissando clock pulses gated by the clock gate 655 are applied to the counter 666 causing the counter to count down. When the counter counts down to zero, it resets the flip-flop 653. Since the difference in the addresses of the previous note and the current note corresponds to the number of half tones of the chromatic scale between the previous note and the current note, the counter provides the exact count of the number of notes played on the chromatic scale during the glissando in going from the pitch of the previous note to the pitch of the new note. Thus the counter provides an accurate way of determining the end point. If the counter is not counted down to zero before a new key is operated on the keyboard during glissando operation, the counter is reset to a new value by the output of the subtract circuit 664 based on the current count condition as stored in the Old Address register 662.

What is claimed is:

1. A key-operated tone generator having automatic glissando between any two successively operated keys, comprising an oscillator for controlling the pitch frequency of the tone generator, oscillator control means responsive to a series of electrically coded frequency numbers for changing the frequency of the oscillator in steps corresponding to the musical scale, means storing frequency numbers for each step of the musical scale, an accumulator register, a hold register, means responsive to operation of a key for transferring a selected frequency number from said means storing frequency numbers to the hold register and transferring the frequency number in the hold register to the accumulator register, compare means for comparing the frequency number in the hold register and accumulator register, means including a clock for periodically multiplying the contents of the accumulator register by a predetermined constant and storing the product in the accumulator register, means applying the contents of the accumulator register to the oscillator control means to control the pitch of the tone generator, and means responsive to the compare means for interrupting the periodic multiplication when the contents of the accumulator register and hold register are substantially equal.

2. Apparatus of claim 1 further comprising means further responsive to the compare means when the contents of the accumulator register and hold register are substantially equal for transferring the contents of the hold register to the oscillator control means.

3. In a keyboard operated tone synthesizer in which the pitch of each note generated by the synthesizer is determined by a frequency control number stored in a table, the number being selected by operation of the associated key and used to set the frequency of an oscillator which fixes the fundamental frequency of the generated tone, a glissando control comprising:

an addressable memory for storing the table of frequency control numbers, a glissando clock, counter means counted in response to the glissando clock for addressing said memory, an address hold register means responsive to operation of any selected key on the keyboard for storing the address of the corresponding frequency number in the table in the address hold register and initiating the counting of said counter means by the glissando clock to address and read out successive frequency numbers from said table, means setting the freqency of the oscillator in response to said series of frequency numbers from said memory for periodically changing the fundamental frequency of the generated tone, means comparing the address in the counter means with the address in the hold register, means interrupting the counting of the counter means when the comparing means indicates the address in the counter and the address in the hold register are the same, and means responsive to the initial operation of a key on the keyboard for initially setting the hold register and the counter means to the address of the corresponding frequency number in the table.

4. Apparatus of claim 1 wherein the comparing means includes means for indicating if the address in the counter is greater or less than the address in the hold register, amd means responsive to said indicating means for controlling whether the counter means counts up or down.

5. Apparatus of claim 3 wherein the glissando clock includes means for selectively changing the clock frequency.

6. Apparatus of claim 1 further including means responsive to the counting of the counter means by the glissando clock for momentarily disabling the keyboard of the tone synthesizer to release the tone generator momentarily with each change of the counter means.

* * * * *